United States Patent [19]

Andersen

[11] 4,406,211

[45] Sep. 27, 1983

[54] ANNULAR SHOCK ABSORBING SYSTEM FOR A MISSILE LAUNCHER

[75] Inventor: William F. Andersen, San Jose, Calif.

[73] Assignee: Westinghouse Electric Corp., Pittsburgh, Pa.

[21] Appl. No.: 287,611

[22] Filed: Jul. 28, 1981

[51] Int. Cl.[3] ..... F41F 3/04

[52] U.S. Cl. ..... 89/1.816; 89/1.809

[58] Field of Search ..... 89/1.816, 1.819, 1.809, 89/1.810

[56] References Cited

U.S. PATENT DOCUMENTS

| | | | |
|---|---|---|---|
| 3,072,022 | 1/1963 | Wood et al. | 89/1.810 X |
| 3,124,040 | 3/1964 | Fiedler | 89/1.816 |
| 3,135,162 | 6/1964 | Kamalian | 89/1.810 |
| 3,221,602 | 12/1965 | Price et al. | 89/1.816 |
| 3,289,533 | 12/1966 | Brown | 89/1.810 |
| 3,367,235 | 2/1968 | Andrews | 89/1.816 |
| 3,392,629 | 7/1968 | Soderberg | 89/1.816 |
| 3,499,364 | 3/1970 | D'Ooge | 89/1.810 |
| 3,857,321 | 12/1974 | Cohen | 89/1.816 X |

*Primary Examiner*—David H. Brown

*Attorney, Agent, or Firm*—F. J. Baehr, Jr.

[57] ABSTRACT

A shock absorbing pad system for a missile launch tube, wherein the shock absorbing pad system comprises a continuously acting inner sheet, an outer segmented sheet and a plurality of chevron shaped struts disposed between the sheets. The continuously acting inner sheet provides compressive, shear, and tensile forces or a combination thereof to resist lateral shock loads and to restore the missile to its central location within the launch tube.

2 Claims, 4 Drawing Figures

ANNULAR SHOCK ABSORBING SYSTEM FOR A MISSILE LAUNCHER

BACKGROUND OF THE INVENTION

This invention relates to shock absorbing pads for a missile and more particularly to shock absorbing pads disposed in a missile launch tube.

One of the basic missile launcher design concepts consists of launching the missile "bare", that is, preventing the missile from contact with the submarine structure and launcher hard areas, and guiding the missile out of the launch tube with the use of structured elastomeric pads bonded to the wall of the launch tube. While the launching function of the elastomeric pad may be their primary function, they must satisfactorily perform at least two other critical functions; guiding the missile into the launch tube during a loading operation, and protecting the missile from shock and vibration while the missile is stored within the launch tube. In each of the above functions, the issue of rattle space or space available for movement of the missile within the launch tube is central to the intended function of the elastomeric pads. During the loading operation, if a greater amount of space is available for the missile, less exact positioning loading equipment may be utilized. Also, when resisting shock, greater available space gives greater protection for a given maximum acceleration of the missile. During launching a greater amount of available space allows for higher cross flows resulting either from motion of the submarine or from movement of the sea.

Any elastomeric pad concept which reduces the net available space for lateral missile motion is undesirable. However, some applications of elastomeric pad technology require a rather high individual pad compression-deflection characteristic, which for the most part, comes at the expense of reduced space available for lateral motion.

In the prior art as shown in FIG. 1, a missile is installed in a launch tube and is prevented from contacting the tube by the elastomeric pads disposed in the annular space between the missile and the launch tube. The missile is shown in its equilibrium or neutral position at rest in the central portion of the launch tube. In this position, there is no force exerted by the elastomeric pads. As the missile is moved in any direction from the central position, it compresses the elastomeric pads, exerting a force on the missile intended to return it to the central position. Essentially, the only force exerted to restore the missile to its central position within the launch tube is the compressive reactant forces within the pads themselves. The pads are normally lined with teflon so that the pads on the side of the missile exert a very low coefficient of friction between the pad and the missile so that the shear forces which would retard movement of the missile are considered negligible. The pads diametrically opposed from those compressed exert no force on the missile so that the only force exerted on the missile to restore it to its central position are from the compressing forces exerted on the pads that are compressed as the missile contacts the elastomeric pads.

SUMMARY OF THE INVENTION

In general, an annular shock absorbing system for a missile launcher, when made in accordance with this invention, comprises a plurality of arcuate shock pads circumferentially disposed around the missile launcher. Each shock pad comprises an arcuate outer sheet, an arcuate inner sheet, and a plurality of chevron shaped struts disposed between the sheets in a spaced relationship. The system also comprises means for joining the inner arcuate sheets into a continuous acting, generally circular sheet, whereby lateral missile movement within the shock absorbing system will be resisted by shear, tensile and compressive forces generated in the shock absorbing system by the lateral missile movement.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
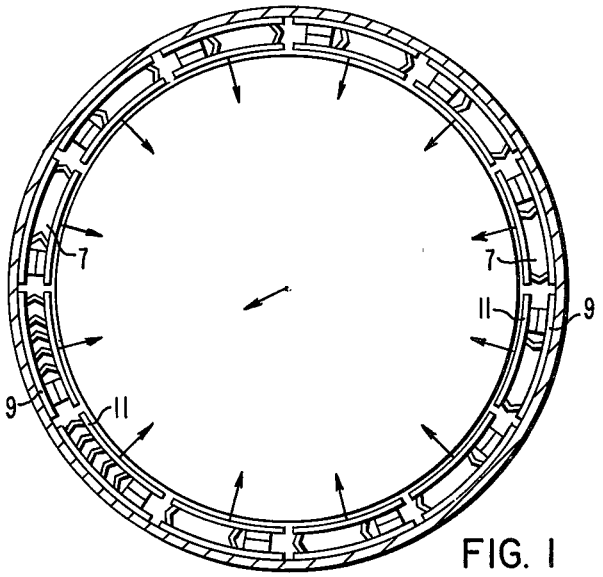
FIG. 1 PRIOR ART
FIG. 1 is a sectional view of a missile launch tube with a prior art shock absorbing system disposed therein.
Figure 2:
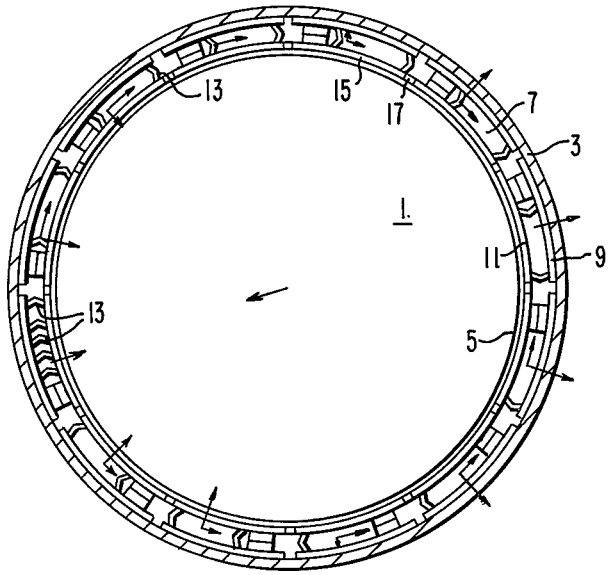
FIG. 2 is a sectional view of a missile launch tube with a shock absorbing system made in accordance with this invention disposed therein.

Referring now to the drawings in detail and in particular to FIG. 2, there is shown an annular shock absorbing system 1 disposed in a missile launch tube 3 with a missile 5 disposed therein.

The shock absorbing system 1 comprises a plurality of arcuate shock pads 7 disposed circumferentially around the missile launch tube 3.

Each shock pad 7 comprises an arcuate outer sheet 9 and an arcuate inner sheet 11 and a plurality of chevron shaped struts 13 disposed in a spaced relationship between the sheets 9 and 11.

The outer sheet 9 is adhesively bonded to the launch tube 3 and the inner sheet 11 has an inner surface 15 coated with teflon or some other tetrafluoroethylene or fluorinated-ethene-propylene resin.

Figure 3:
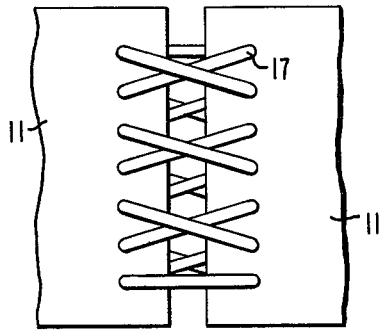
FIG. 3 is a partial-sectional view showing one way of joining adjacent shock absorbing pads.
Figure 4:
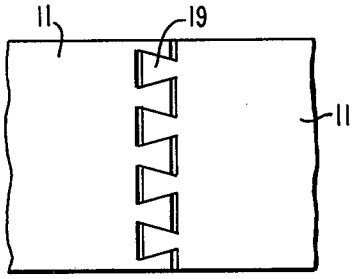
FIG. 4 is a partial-sectional view of an alternative way of joining adjacent shock absorbing pads.

FIGS. 3 and 4 show alternate means for joining the inner arcuate sheets 11 into a continuous acting, generally circular sheet. Other means for joining the inner sheet 11 such as staples, or elastomer bands which support tension but not compression, may be utilized. Lacing 17 as shown in FIG. 3 advantageously allows for varying the spacing between adjacent pads while dovetail joints 19 shown in FIG. 4 would advantageously require substantially less installation time, it being understood that these two or other means for joining adjacent pads could be used conjunctively as it is desirable to have at least variable spacing joining means in each continuous acting, generally circular inner sheet.

The continuous acting inner sheet advantageously joins all pads in a shock absorbing system wherein each pad contributes to the force required to resist lateral movement of the missile and restore it to its central location within the launch tube. Generally, those pads contacted by the missile as it moves laterally with respect to the launch tube are compressed, producing a compressive restoring force as shown in the prior art. However, those pads diametrically opposed to the compressed pads are subjected to a tensile loading via the continuous acting inner sheet 11 to apply tensile forces within the pad to restore the missile to its central location within the launch tube. In the prior art device, the same pads were essentially (except for slight preload) unaffected by lateral movement toward opposed pads. The pads on the side of the missile as it moves laterally in the prior art device supplied little or no resistance or restoring forces as they are coated with teflon which has a very low-coefficient of friction. However, in the present design, they are subjected to shear forces and resist lateral movement of the missile due to internal shear generated by the continuous acting sheet as the missile is moved to compress some of the pads. This shear generated within the pads also produces a restoring force to return the missile to its central location within the launch tube. Thus, each and every individual pad provides compressive, shear, or tensile forces or a combination thereof to resist lateral missile movement and also to restore it to its central location within the launching tube, substantially increasing the effect of the shock absorbing pads upon lateral movement of the missile within the launch tube.

What is claimed is:

1. An annular shock absorbing system for a missile launcher comprising a plurality of arcuate shock pads circumferentially disposed around said missile launcher; each shock pad comprising an arcuate outer sheet, an arcuate inner sheet, and a plurality of chevron shaped struts disposed between said sheets in a spaced relationship; and means for joining said inner arcuate sheet into a continuously acting, generally circular sheet, whereby lateral missile movement within said shock absorbing system will be resisted by shear, tensile and compressive forces generated in said shock absorbing system by the lateral missile movement.

2. An annular shock absorbing system for a missile launcher as set forth in claim 1, wherein the inner surface of the inner sheets are coated with tetrofluoroethylene.

* * * * *